US006342841B1

(12) United States Patent
Stingl

(10) Patent No.: US 6,342,841 B1
(45) Date of Patent: Jan. 29, 2002

(54) INFLUENT BLOCKAGE DETECTION SYSTEM

(75) Inventor: David A. Stingl, Great Falls, VA (US)

(73) Assignee: O.I.A. LLC, McLean, VA (US)

( * ) Notice: Subject to any disclaimer, the term of this patent is extended or adjusted under 35 U.S.C. 154(b) by 0 days.

(21) Appl. No.: 09/288,955

(22) Filed: Apr. 9, 1999

Related U.S. Application Data

(60) Provisional application No. 60/081,384, filed on Apr. 10, 1998.

(51) Int. Cl.[7] ..... G08B 21/00

(52) U.S. Cl. ..... 340/626; 340/606; 340/608; 340/627

(58) Field of Search ..... 340/626, 627, 340/614, 606, 611; 417/44.2

(56) References Cited

U.S. PATENT DOCUMENTS

| | | | | |
|---|---|---|---|---|
| 2,680,168 A | | 6/1954 | Murphy | 200/83 J |
| 2,767,277 A | | 10/1956 | Wirth | 200/832 |
| 4,107,492 A | | 8/1978 | Moon, Jr. et al. | 200/819 M |
| 4,115,878 A | | 9/1978 | Johnson et al. | 4/492 |
| 4,116,577 A | | 9/1978 | Lauck | 417/286 |
| 4,329,120 A | * | 5/1982 | Walters | 417/12 |
| 4,456,432 A | | 6/1984 | Mannino | 417/2 |
| 4,460,812 A | | 7/1984 | Asahi | 200/83 |
| 4,505,643 A | | 3/1985 | Millis et al. | 417/12 |
| 4,602,391 A | | 7/1986 | Shepherd | 4/541.4 |

(List continued on next page.)

OTHER PUBLICATIONS

A. Sanderfoot, "Too Late, But Not Too Little," AQUA, vol. 21, No. 7, Jul. 1996, Editor'Letter.

E.S. Pollock, "Unrecognized Peril?", AQUA, vol. 21, No. 7, Jul. 1996, pp. 63–64.

Dayton Electric Mfg. Co., Operating Instructions & Parts Manual, TEEL Vacuum–on Switch, Item No. IV346, Printed in U.S.A.

(List continued on next page.)

*Primary Examiner*—Jeffery Hofsass
*Assistant Examiner*—Son Tang
(74) *Attorney, Agent, or Firm*—James Creighton Wray; Meera P. Narasimhan

(57) ABSTRACT

A microcontroller establishes normal operation and vacuuming operation profiles of time and vacuum for a pool or spa circulating pump. A user slightly adjusts the levels of vacuum within a predetermined range for storing a vacuum profile envelope within the memory for a normal pump circulating operation and a vacuum profile envelope within the memory for a vacuuming operation. A comparator compares actual inputs of time-from-start and pump vacuum with the normal operation envelope during normal operation of the circulating pump. The comparator compares real time inputs of the sensed vacuum and the time-from-start when the controller is in the vacuuming mode with the vacuuming envelope stored in the memory. Deviations of the sensed pressures from the envelope cause pump shutdown and alarm activation. A calibration switch is positioned inside a locked weatherproof control enclosure. That switch must be pressed before a pump start switch is started for normal circulating operations, or a vacuum switch is pushed for a pool or spa vacuuming operation. During or after the automatic calibration, variations of expanding or shrinking a deviation envelope may be controlled by switches before the calibration switch is deactivated. Lights blink with sequences to indicate selected vacuum levels, and the levels are displayed on an alphanumeric display. An auto restart switch is also located inside the locked control enclosure for allowing the system to automatically close the power relay and restart the pump after power outages.

28 Claims, 3 Drawing Sheets

U.S. PATENT DOCUMENTS

| | | | | | |
|---|---|---|---|---|---|
| 4,620,835 | A | | 11/1986 | Bell | 417/17 |
| 4,762,969 | A | | 8/1988 | Tracey | 200/81.4 |
| 4,783,580 | A | | 11/1988 | Bassin | 200/81.4 |
| 4,861,231 | A | | 8/1989 | Howard | 417/38 |
| 4,867,645 | A | | 9/1989 | Foster | 417/38 |
| 5,120,198 | A | | 6/1992 | Clark | 417/12 |
| 5,167,041 | A | | 12/1992 | Burkitt, III | 4/541.2 |
| 5,190,442 | A | | 3/1993 | Jorritsma | 417/7 |
| 5,259,733 | A | * | 11/1993 | Gigliotti et al. | 417/38 |
| 5,318,409 | A | * | 6/1994 | London et al. | 417/53 |
| 5,347,664 | A | | 9/1994 | Hamza et al. | 4/509 |
| 5,361,215 | A | * | 11/1994 | Tompkins et al. | 364/505 |
| 5,499,406 | A | | 3/1996 | Chalberg et al. | 4/541.2 |
| 5,570,481 | A | * | 11/1996 | Mathis et al. | 4/541.2 |
| 5,601,413 | A | * | 2/1997 | Langley et al. | 417/12 |
| 5,682,624 | A | | 11/1997 | Ciochetti | 4/509 |
| 5,690,476 | A | | 11/1997 | Miller | 417/44.2 |
| 5,725,359 | A | | 3/1998 | Dongo et al. | 417/44.9 |
| 5,772,403 | A | * | 6/1998 | Allison et al. | 471/44.2 |
| 5,796,184 | A | | 8/1998 | Kuhnl et al. | 307/118 |
| 6,039,543 | A | * | 3/2000 | Littleton | 417/12 |
| 6,059,536 | A | * | 5/2000 | Stingl | 417/44.2 |

OTHER PUBLICATIONS

CalSpa Product Brochure, Smart Control Center, Built–In Safety Suction Shutdown.

P. McKain and R. Downey, Play Safe Pool System Information & Statistics, Handout Literature, 1999.

N. Antl, "Citizens Design Protection Device," Swimming Pool/Spa Age, Jan., 1998.

Stingl–Switch Influent Blockage Detection System, Operator/Installation Manual, Model SS–401, Low End Residential Model, Rev 1.0.

* cited by examiner

INFLUENT BLOCKAGE DETECTION SYSTEM

BACKGROUND OF THE INVENTION

This application claims the benefit of U.S. Provisional Application No. 60/081,384, filed Apr. 10, 1998.

SUMMARY OF THE INVENTION

A Stingl-Switch is designed to give years of safe operation of a swimming pool, hot tub or spa. The Stingl-Switch is designed to prevent only body entrapment. To prevent disembowelment accidents, one must have properly installed and secured drain covers. Inspect the drain covers for cracks, fatigue, ultraviolet light or chemical degradation on a daily basis. Drain covers are inexpensive and if a problem is even suspected, replace the grate using only the manufacturer's supplied cover and stainless steel screws. Although there is no physiological data currently available as to how rapidly a disembowelment occurs, it is believed that the Stingl-Switch would lessen the physical damage inflicted. To prevent hair entrapment, use factory supplied anti-vortex drain covers. Anti-vortex drain covers are effective only at specific flow rates. Ensure that the flow rate is not exceeded. Contact the builder and the manufacturer of anti-vortex drain covers for specifics.

A preferred pool or spa circulating pump shut-off assembly has a water-circulating pump. A pump relay is connected to a power source. Pump power lines are connected to the pump relay and the pump for operating the pump. A sensor is connected to the pump for sensing change in fluid pressure in the pump. A processor is connected to the sensor for receiving signals from the sensor and for storing signals from the sensor during calibration. A comparator is connected to the processor for comparing real time signals from the sensor with stored calibration signals. The pump relay is connected to the processor for changing the relay and shutting off the pump assembly in response to substantial differences between real time signals and stored signals.

A preferred pump control switch apparatus for a pool or spa has a pump motor relay. A control is connected to the pump motor relay and a processor is connected to the control. A memory is connected to the processor. A vacuum sensor has an input connected to a suction side of a pump and an output connected to the processor. A timer is connected to the processor. A start switch is connected to the pump relay to start the pump. A calibration switch is connected to the processor for starting a calibration sequence wherein the processor records in the memory inputs from the timer and vacuum sensor during normal operation of the pump. A comparator is connected to the processor for comparing real time inputs to the processor from the timer and from the sensor with recorded inputs from the timer and sensor during calibration. An alarm relay is connected to the processor. The processor is connected to the pump relay and the alarm relay for opening the pump relay to turn off the pump and closing the alarm relay to turn on the alarm.

A preferred pool or spa water circulating pump control apparatus has a water-holding body, a water inlet and a water outlet connected to the body of water. A water return pipe is connected to the outlet. A suction pipe is connected to the inlet. A filter is connected to one of the pipes. A circulating pump has a suction side connected to the suction pipe and has a discharge side connected to the return pipe. A pressure sensor is connected to the suction pipe or to the suction side of the pump for sensing pressure therein.

A normally open pump relay has first and second power terminals. Electric power lines are connected to the first terminals of the pump relay. Pump power lines are connected to the pump and to second terminals of the pump relay. A transformer has a low voltage output and a high voltage input connected to the power lines. An alarm relay has energizing terminals. First and second power terminals are connected to the transformer and to the alarm. A direct current power supply is connected to the transformer.

A microcontroller is connected to the power supply, to the pressure sensor, to the pump relay and to the alarm relay, and a timer is connected to the microcontroller.

Under a calibration condition, the microcontroller reprograms a memory during normal circulating pump operation and then during vacuum cleaning operation of the circulating pump. The memory stores sensed pressure and time-from-start related variations of sensed pressure. An on-off switch is connected to the microprocessor for turning the microprocessor off or on. A start switch is connected to the microcontroller for starting the microcontroller in pump circulating condition for energizing the pump relay to operate the pump. An auto start switch is connected to the pump for automatically restarting the pump and controller when the power lines are activated by a timer control circuit. A vacuum cleaning switch is connected to the microcontroller for setting the microcontroller in vacuum cleaning condition and for energizing the pump relay to operate the pump. A calibration switch is connected to the microcontroller for reprogramming the memory. A comparator in the microcontroller compares present pressure and time-from-start with a profile of times and pressures stored in the memory. Out of scale differences actuate the microcontroller for energizing the alarm relay and deenergizing the pump relay, respectively turning on the alarm and turning off the pump.

These and further and other objects and features of the invention are apparent in the disclosure, which includes the above and ongoing written specification, with the claims and the drawings.

DETAILED DESCRIPTION OF THE PREFERRED EMBODIMENTS

Each pump system (comprised of a pump, pipes, fittings, drain, etc.) has a unique vacuum profile. The Stingl-Switch works by monitoring vacuum on the influent side of a pool or spa pump and by comparing the vacuum against the known (calibrated) profile for the system. Any deviation from that calibrated profile indicates a possible trouble situation with the pump system, for which the Stingl-Switch can then take appropriate action.

Figure 1:
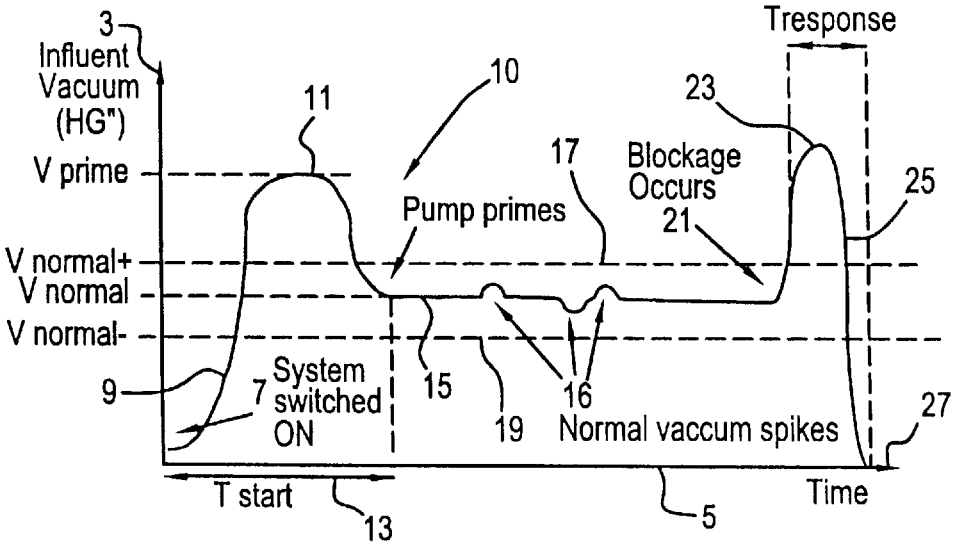
FIG. 1 is a typical vacuum profile for a pump system in normal operation.

FIG. 1 shows the basic shape of such a vacuum profile, which compares pump influent vacuum 3 with time 5.

When power is first applied to the pump motor, several things happen before the pump system reaches steady-state "normal" operation. The mechanical inertia of the motor must be overcome as it comes up to operating RPM. The water standing in the pipes must be accelerated from a stationary state to the standard flow rate of the system. Depending on the location of the pump in relation to the pool, air may need to be primed out of the lines before water begins to flow. These "start up factors" result in a vacuum reading at the influent side of the pump starting at zero inches of mercury (0" Hg) at power on 7, quickly rising 9 to a maximum value (Vprime) 11, then finally leveling off to some "normal" value. The amount of time required for the system to go from a stand still to normal flow is called Tstart 13.

Once the pump system has primed, the pump system will reach a "steady state" vacuum called Vnormal 15. Because normal operation of the system can cause minor fluctuations 16 in vacuum, and activity near the drain can cause small, harmless increases in vacuum, a "false alarm margin" of Vnormal+ 17 is provided. Vnormal– 19 provides a margin against small drops in vacuum that may be caused by power fluctuations, as well as a "failsafe" in case the vacuum sense line to the Stingl-Switch is damaged or tampered with.

When a blockage occurs 21, the moving column of water in the system will suddenly stop, causing a sharp spike 23 in vacuum. As the system vacuum exceeds Vnormal+ 17, the Stingl-Switch turns off the pump. The vacuum in the system will drop 25 to zero 27 very quickly. There is no need to "relieve" residual vacuum in the line because water is not compressible. The response time depends on the length of the drain lines, but it will usually be well less than 1 second. The blockage event will also cause internal and external audio and visual alarms to activate, indicating to the operator and maintenance personnel that a potential entrapment has occurred. The system must be restarted manually after the blockage is removed, preventing accidental restart during a rescue operation.

Because all pump systems are different in physical layout, the parameters of Tstart 13 and Vnormal 15 are different for each system. The values for the specific installation are automatically determined by the Stingl-Switch during the calibration mode, which, for safety reasons, may be activated only from inside the locked control box. In addition, the operator may want some flexibility in Vnormal+ and Vnormal– to determine the "sensitivity" of the system. A small margin about Vnormal causes more false alarms. However, the Stingl-Switch has pre-programmed limits so that the operator cannot unintentionally disable the effectiveness of the system by making the margin too large.

Figure 2:
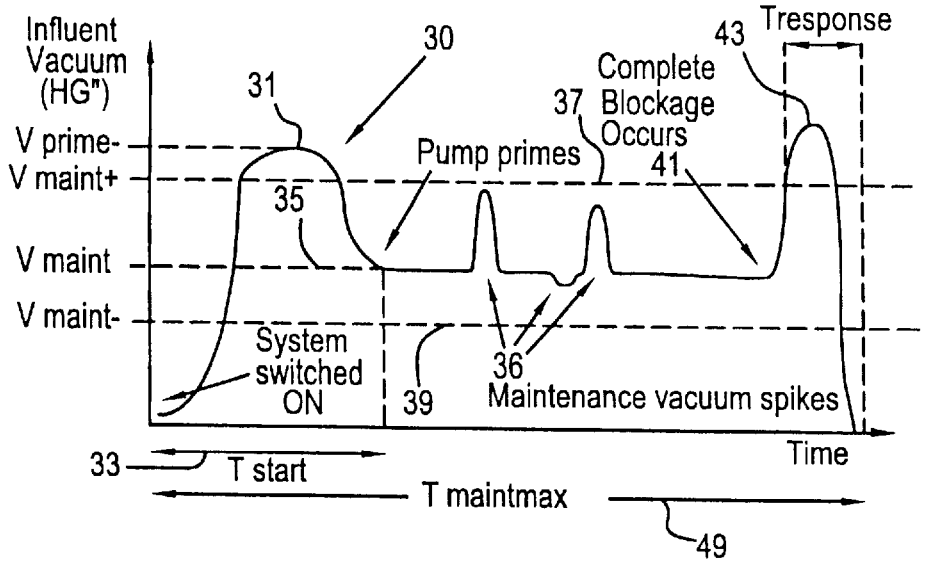
FIG. 2 is a vacuum profile of the Stingl-Switch in maintenance bypass mode.
Figure 3:
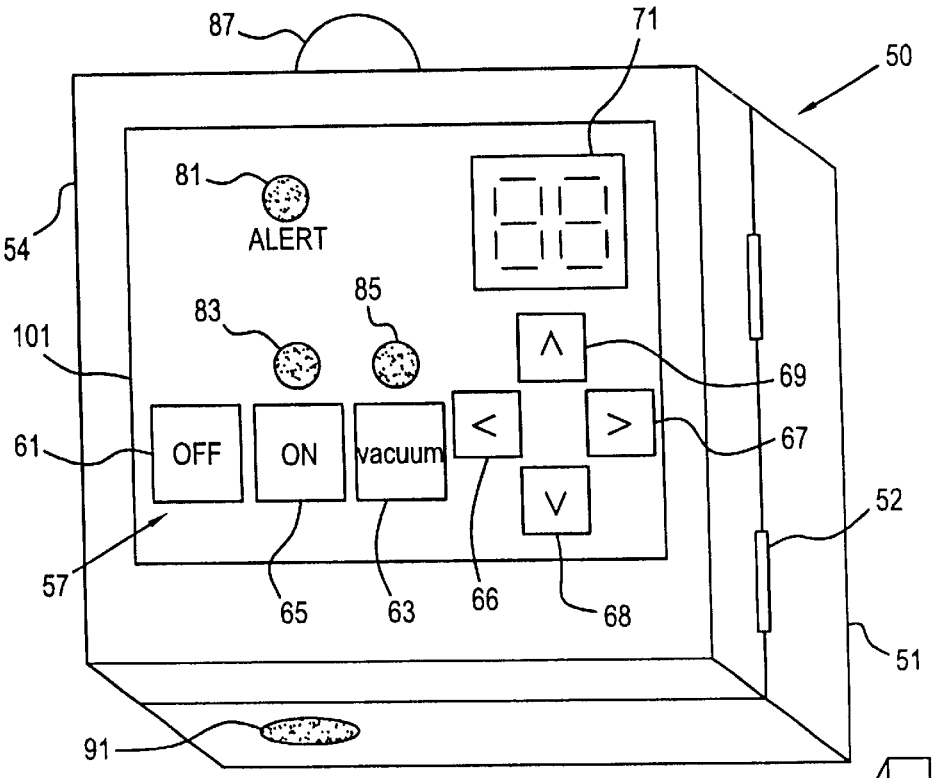
FIG. 3 is a perspective view of the pump control box.

Most swimming pool and spa pump systems are used for operations other than normal filtration. In almost all cases (except very small spas), the pump system may also be connected to a vacuum wand to vacuum the pool. In that condition, the use of the vacuum wand may often cause spikes in the vacuum level similar to an entrapment, which would normally cause the Stingl-Switch to prematurely shut down the system. Because of this, the Stingl-Switch also has a Maintenance Bypass Mode. Instead of just disabling the safety feature of the switch, however, the system switches to the alternate maintenance vacuum profile 30, as shown in FIG. 2.

The profile is similar in shape to FIG. 1, which shows the normal operation vacuum profile 10. However, in most pool systems the use of the vacuum wand is also accompanied by changing the position of several of the influent valves in the system (to increase vacuum at the vacuum wand). With some of the influent valves closed, the volume of the water in the system may change significantly, causing new values for Vprime 31, Tstart 33 and Vmaint 35. Because of the nature of vacuuming the pool, the vacuum spikes 36 are also larger, hence the larger Vmaint+ 37 and Vmaint– 39 margin. However, since a complete blockage 41 causes even larger spikes 43 than vacuuming, the pool or spa is still protected from an accidental entrapment. Those values are all determined automatically after installation in the calibration process.

In addition, a new parameter, Tmaintmax 49, sets the maximum amount of time the system may be in maintenance bypass mode. That prevents the system from accidentally being left in maintenance bypass mode, reducing (but not eliminating) the safety factor of the Stingl-Switch. The audio and visual alarm also activates intermittently to remind both operators and guests that the system is not in full safe mode.

As shown in FIGS. 3–6, the Stingl-Switch 50 is also equipped with an autostart function. That mode is selected from a switch inside the control box 51. When activated, the pump automatically starts when power is applied to the pump control box 51. That option is desirable for installations where the pump must be started without human intervention (the pump is controlled by an external time clock, or areas where power is frequently lost, etc.). The front panel 54 may be connected by hinges 52 to the pump control box 51.

Figure 5:
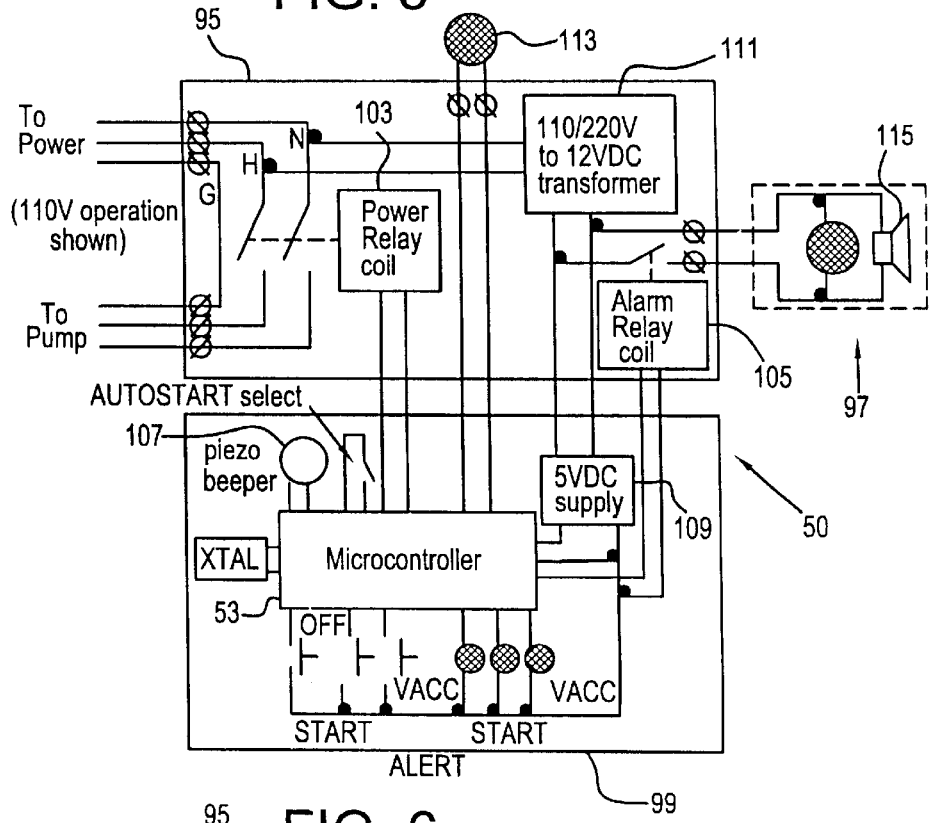
FIGS. 5 and 6 are a schematic diagrams of the logic board and the high voltage board.
Figure 6:
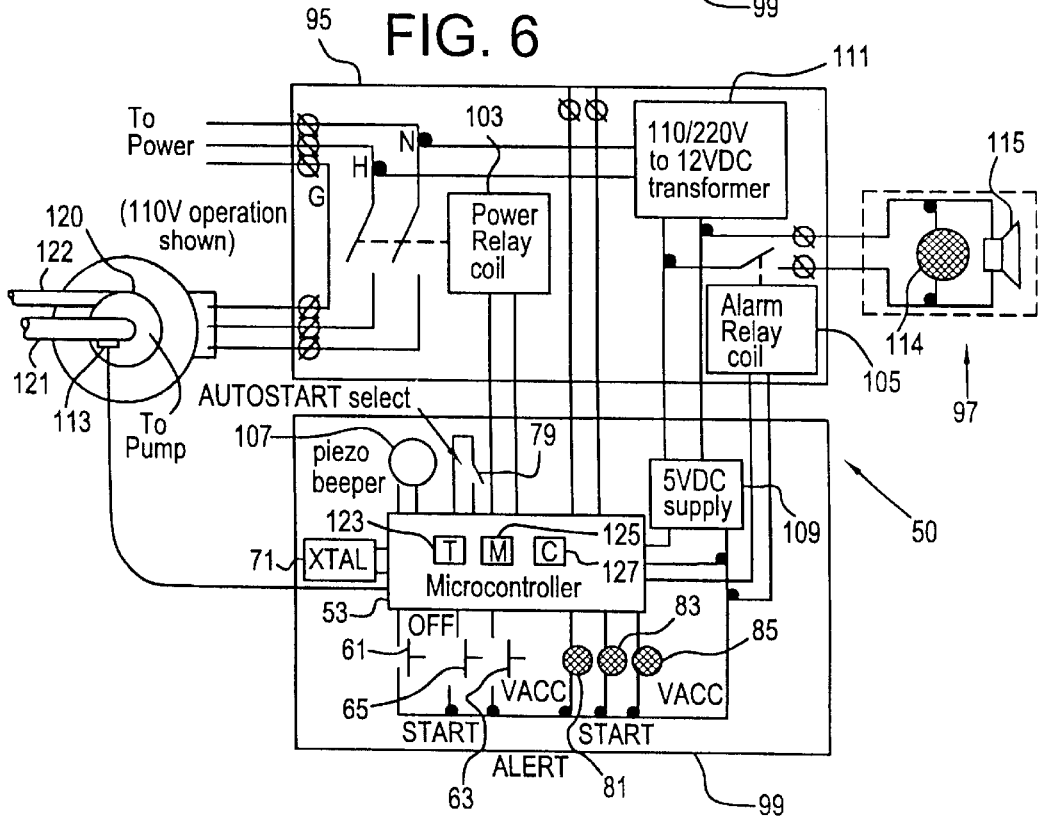

All functions of the Stingl-Switch are provided by an intelligent microprocessor 53 (FIGS. 5 and 6). Calibration values are stored in non-volatile EEPROM memory to prevent loss during power failures or intentional disconnects.

Connections 55 are provided for attachment of optional external audio and visual alarms.

The front panel 54 has the following switches 57: off 61, vacuum 63, on 65 and edit switches 66, 67, 68 and 69. The off switch 61 turns the pump and alarm off. The vacuum switch 63 turns the pump on for pool vacuuming (alarm sounds intermittently). The on switch 65 starts the pump. Alarms sound while the safety feature is disabled during the start sequence. The edit switches 66, 67, 68 and 69 are used for viewing and editing parameters in the 7-element LED display 71.

Figure 4:
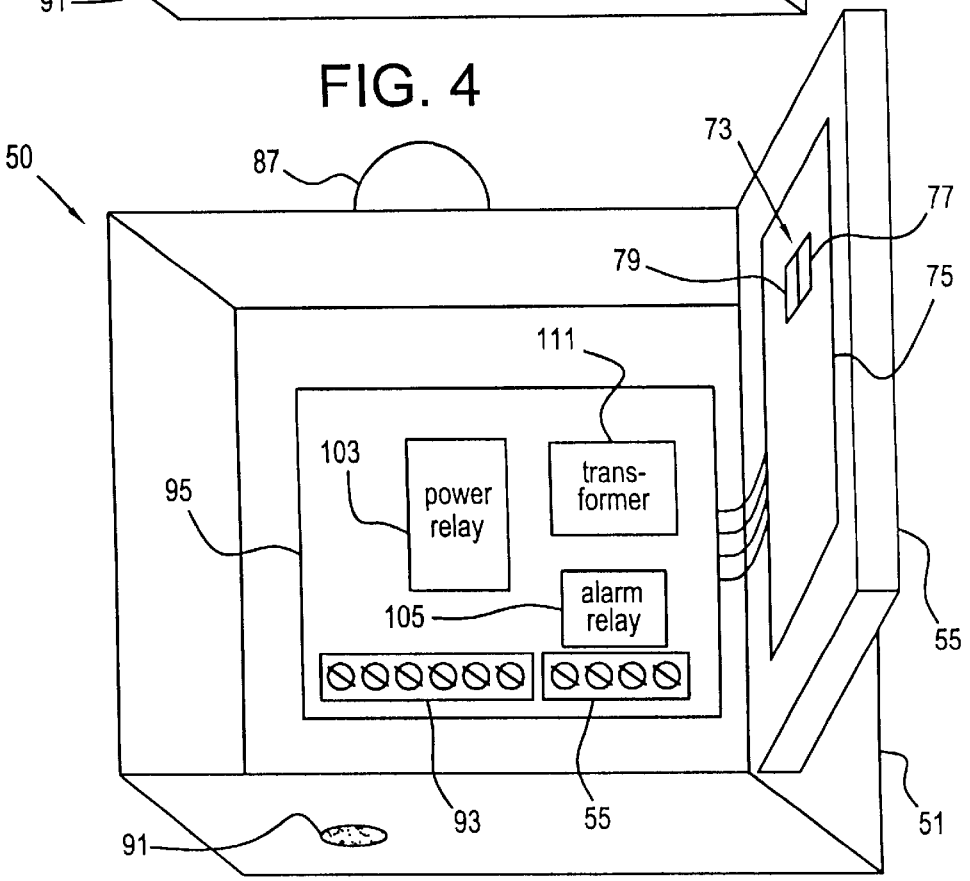
FIG. 4 is a perspective view of the internals of the pump control box.

Internal switches 73, shown in FIG. 4, are mounted on the back cover 75 of the logic board. The calibrate switch 77 is pressed to initiate an automatic calibration sequence. The autostart switch 79 is pressed to request the pump to automatically start when power is applied to the system. When the autostart switch 79 is in the on position, starting the pump does not require an operator to manually press the on switch 65.

Lights are shown on the box cover front panel 54. The alert light 81 is a red LED that provides alarm indication and blinks when blockage is detected until manually reset. Various error messages are also displayed.

The start light 83 is a green LED that indicates that the motor is running and that the safety feature is enabled. The start light 83 blinks once per second while the system pump is starting and is also used after calibration to count out the vacuum set point.

The vacuum light 85 is a green LED that indicates when the system is in vacuum bypass mode.

The two-digit display 71 displays various parameters.

An external bright strobe light 87 flashes in synchronization with the red LED alert light 81 above.

The red LED alert light 81 and audible sounds are synchronized. Flash sequences of light 81 may be replaced with distinct two-digit error codes.

A constant flash of light (flash-flash-flash-flash) indicates that entrapment has occurred and that the Stingl-Switch has tripped.

A single flash with a pause (flash-pause-flash-pause) indicates that the system is in a start cycle and that the pump is priming so the safety mode is bypassed. The system automatically turns itself off after 30 seconds if prime does not occur.

Two flashes with a pause (flash-flash-pause-flash-flash-pause) indicates that the system is in vacuum bypass mode and the safety mode is bypassed. The system automatically turns off after 30 minutes if left in the vacuum mode.

Three flashes with a pause (flash-flash-flash-pause-flash-flash-flash-pause indicates that the system failed to prime in the calibrated time in the autostart mode.

Four flashes with a pause (flash-flash-flash-flash-pause-flash-flash-flash-flash-pause) indicates that the vacuum bypass has exceeded 30 minutes and that the system has shut itself down automatically.

To start the system, press the on switch 65. The green lamp 83 over the on switch 65 blinks as the pump primes. The red lamp 81 blinks to indicate that the pump is priming. The green lamp 83 stays on when the pump primes and the system is "armed." All other lights go out at that time.

To stop the system, press the off switch. All lights will extinguish, and the pump stops.

To vacuum, the system must be in the off mode. Once the system is in the off position, press the vacuum switch 63. The green lamp 83 over the on switch 65 blinks as the pump 120 primes, drawing water in through suction line 121 and pumping water out through discharge line 122. The red lamp 81, the green lamp 83 over the on switch 65 and the green lamp 85 over the vacuum switch 63 blink to indicate the start sequence (like in the system start-up sequence above). The green lamps 83 and 85 over the on and vacuum switches 65 and 63, respectively, stay on after the pump has successfully primed. The red lamp 81 blinks to indicate that the safety mode is bypassed. The system stays in the vacuum mode a maximum of 30 minutes before automatically shutting itself off.

In an entrapment situation, the system senses the entrapment and automatically shuts off the pump and sounds alarms. Once the obstruction is cleared from the drain or skimmer, press the off switch 61 to reset the system. Press the on switch 65 to start the system, as described in the start-up sequence above. The system must be manually reset after an entrapment by pressing the off switch 61, whether the regular or autostart feature is enabled.

Calibration of the system must be done after installation. Press the calibrate switch 77 on the inside of the pump control box 51. The calibrate switch 77 is inside to prevent accidental unauthorized operation. The system performs a start sequence as if in autostart mode. The microprocessor calculates the proper safe vacuum level from the measured normal vacuum level and determines the amount of time required for normal priming of the pump. During calibration, the alarm sounds to indicated that the safety feature has not yet been activated. Failing to calibrate the system at first power on will cause the red lamp 81 to flash an error message, and the system will not operate. When calibration is complete, the green lamp 83 over the on switch 65 will blink to display the calculated safe vacuum level. For example, eleven flashes and a pause indicates that the safe vacuum level is set at eleven inches of Hg. To start the system, press the off switch 61 and then start the system as described above.

The system is installed in the following steps:

Mount the pump control box 51 in a convenient location near the pump. Connect the vacuum sensor 113 to the port on the influent side of the pump, using a T-fitting if appropriate. Route wires from the sensor 113, through the grommet 91 in the pump control box 51. Connect the wires from the sensor 113 to the appropriate terminals 55. Disconnect power lines to the pump. Connect power from the circuit supply to the input terminals 93 on the high voltage board 95 as marked. Connect the pump to the output terminals 93 on the high voltage board 95 as marked. The standard Stingl-Switch is equipped for 110V and 220V operation. Jumper appropriately for 110V or 220V operation.

Install the external light 114 and siren box 97. Route the low voltage wires through the grommet 91. Connect to the appropriate terminals 55 on the high voltage board 95.

Select autostart mode off or on by the switch 79 on the back 75 of the logic board 99. Use the on mode for installations where pumps are controlled by an external timer or controller, or where power to the system is frequently lost. In the off mode, the pump will turn off at power failure and will not restart without human intervention.

Restore power to system. Press the calibrate 77 switch inside the pump control box 50. The system will perform an automatic calibration sequence, determining the proper safe vacuum level and the normal time to prime, and will store the profile 10 of time from timer 123 and pressure from sensor 113 in memory 125. The stored normal operating profile 10 and vacuuming profile 30 are compared with real time pressure signals from sensor 113 and time from timer 123 in comparator 127. After calibration, the green lamp 83 over the on switch 65 will flash to indicate the calculated safe vacuum level. The alarm 115 will sound during calibration to indicate that the safety system has not been enabled. Press the off switch 61 to leave the calibration mode. Installation of the system is now complete.

For maintenance work, unintended pump shutdowns may be prevented by using the vacuum mode. When in this mode however, the safety feature of the Stingl-Switch is reduced, so lights and alarms will sound to remind maintenance engineers to reset the safety feature when maintenance is complete. For safety reasons, the Stingl-Switch will disable the vacuum mode automatically after 30 minutes and signal that situation.

The logic for the Stingl-Switch is divided between the logic board 99 and the high voltage board 95. The high voltage board 95, as the name implies, incorporates all of the high voltage in the system, keeping it safely away from the low voltage logic board 99 and the operator switch panel 101. A tap of 120VAC or 220VAC is transformed to 12VDC by transformer 111 to provide power for the coil on the power relay 103 and the alarm relay 105, as well as offboard power to the logic board 99.

The power relay 103 is rated for 20 amps per line. The power relay 103 is connected between the supply voltage and the pump via a terminal strip. The power relay is controlled directly by the logic board 99.

The alarm relay 105 switches 12 volts DC to the external siren 115 and light under control of the logic board 99. Terminals 55 are provided for easy hookup of the external light and siren panel 97.

The logic board 99 contains all of the low-voltage devices in the system: the three front panel push switches 61, 63 and 65; the autostart toggle switch 79; three LEDs 81, 83 and 85; a piezoelectric beeper 107, the microcontroller 53; associated circuitry; and the low voltage power supply 109. A small cable connects the logic board 99 to the high voltage board 95.

While the invention has been described with reference to specific embodiments, modifications and variations of the invention may be constructed without departing from the scope of the invention, which is defined in the following claims.

I claim:

1. A pool, spa or whirlpool bath circulating pump shut-off assembly comprising a water-circulating pump, a pump relay connected to a power sources, pump power lines connected to the pump relay and the pump for operating the pump, a sensor connected to the pump for sensing change in fluid pressure at a suction or discharge of the pump, a processor having a memory connected to the sensor for storing calibration signals from the sensor upon starting and operating the pump during calibration, and a comparator in the processor for comparing real time signals from the sensor with the stored calibration signals, the pump relay connected to the processor for operating the relay for shutting off the pump in response to substantial differences in real time and stored signals.

2. The apparatus of claim 1, further comprising a range spreading input connected to the processor for increasing range of pressure beyond the stored calibration signals within predetermined limits.

3. The apparatus of claim 1, further comprising a display connected to the processor for displaying condition of the processor and level of the stored calibration signals.

4. The apparatus of claim 1, further comprising a start switch and a pool vacuuming switch separately connected to the processor for starting the pump in a circulating mode and in a pool vacuuming mode, a calibration switch connected to the processor for placing the processor in a calibration mode before operating the start switch or the pool vacuuming switch, a memory connected to the processor for separately storing profiles of times from start and pressures after selection of the calibration mode and during operation of the pump following activation of the start switch or activation of the pool cleaning switch.

5. The apparatus of claim 4, further comprising a locked weatherproof control enclosure, and wherein the calibration switch is mounted within the locked control enclosure and the start switch and pool cleaning switch are activatable from an outside of the locked control enclosure.

6. The apparatus of claim 5, wherein the processor controls the alarm relay to periodically activate the alarm after activation of the pool vacuuming switch.

7. Pump control switch apparatus for a pool, spa or whirlpool bath comprising a pump motor relay, a control connected to the pump motor relay, a processor connected to the control, a memory connected to the processor, a vacuum sensor having an input connected to a suction side of a pump and having an output connected to the processor, a timer connected to the processor, a start switch for starting the pump, a calibration switch connected to the processor for starting a calibration sequence wherein the processor records in the memory inputs from the timer and vacuum sensor during normal operation of the pump, and a comparator connected to the processor for comparing real time inputs to the processor from the timer and the sensor with inputs from the timer and sensor stores during calibration, an alarm relay connected to the processor, the processor connected to the pump relay and the alarm relay for operating the pump relay to turn off the pump, and operating the alarm relay and turn on the alarm.

8. The apparatus of claim 7, further comprising a pool vacuuming switch separately connected to the processor for starting the pump in a circulating mode and in a pool vacuuming mode, a calibration switch connected to the processor for placing the processor in a calibration mode before operating the start switch or the pool vacuuming switch, a memory connected to the processor for separately storing profiles of times from start and pressures after selection of the calibration mode and during operation of the pump following activation of the start switch or activation of the pool cleaning switch.

9. The apparatus of claim 8, wherein the processor controls the alarm relay to periodically activate the alarm after activation of the pool vacuuming switch.

10. The apparatus of claim 7, further comprising a locked weatherproof control enclosure, and wherein the calibration switch is mounted within the locked weatherproof control enclosure and the start switch and pool cleaning switch are activatable from an outside of the locked control enclosure.

11. Pool, spa or whirlpool bath water circulating pump control apparatus comprising:

a water-holding body;

a water inlet and a water outlet connected to the body;

a water return pipe connected to the water outlet;

a suction pipe connected to the water inlet;

a filter connected to the one of the pipes;

a circulating pump having a suction side connected to the suction pipe and having a discharge side connected to the return pipe;

a pressure sensor connected to the suction side of the pump or to the suction pipe for sensing pressure therein;

a normally open pump relay having first and second power terminals and an energizing terminal;

electric power lines connected to the first power terminals of the pump relay;

pump power lines connected to the pump and connected to second power terminals of the pump relay;

a transformer having a low voltage output and having a high voltage input connected to the power lines;

an alarm relay having an energizing terminal and first and second power terminals;

the first power terminals of the alarm relay connected to the transformer;

an alarm connected to the second power terminals of the alarm relay;

a direct current power supply connected to the transformer;

a microcontroller connected to the power supply, to the pressure sensor, to the pump relay and to the alarm relay;

a timer connected to the microcontroller;

a memory in the microcontroller recording a profile of times from the timer and pressures from the sensor;

an on-off switch connected to the microprocessor for turning the microprocessor off or on;

a start switch connected to the microcontroller for starting the microcontroller in pump circulating condition for energizing the pump relay to operate the pump;

a vacuum cleaning switch connected to the microcontroller for setting the microcontroller in vacuum cleaning condition and for energizing the pump relay for closing the pump relay and operating the pump;

a calibration switch connected to the microcontroller for reprogramming the memory in the microcontroller separately during normal circulating operating and during vacuum cleaning operation of the circulating pump and for storing a profile of sensed pressures and times; and a comparator in the microcontroller for comparing present line of operation and pressure with times and pressures stored in the memory for actuating the microcontroller upon substantial differences for energizing the alarm relay and deenergizing the pump relay for respectively turning on the alarm and turning off the pump.

12. The apparatus of claim 11, further comprising a locked weatherproof control enclosure, and wherein the calibration switch is mounted within the locked weatherproof control enclosure and the start switch and pool cleaning switch are attractable from an outside of the locked control enclosure.

13. The apparatus of claim 11, wherein the processor controls the alarm relay to periodically activate the alarm after activation of the pool vacuuming switch.

14. A method of controlling a pool or spa circulating pump, comprising operating the circulating pump, sensing vacuum on a suction side of the pump, signaling that sensed vacuum to a microcontroller, activating a calibration mode of the microcontroller and storing operating signals from the sensor in a memory associated with the microcontroller, comparing stored signals in the memory, sensing real time signals by sensing operating vacuum on the suction side of the pump during later operating of the pump and providing real time signals from the sensed operating vacuum to the microcontroller, comparing the real time signals with the stored signals in the microprocessor, and stopping the circulating pump upon significant deviation of the real time signals from the stored signals.

15. The method of claim 14, further comprising vacuuming the pool or spa with the pump, sensing vacuum on the pump during the vacuuming, storing the signals as vacuuming calibration signals related to the sensed vacuum during vacuuming in the memory, providing real time vacuuming signals to the microcontroller during later pool or spa vacuuming operations, comparing the real time vacuuming signals to the stored calibration signals and stopping the pump upon experiencing significant deviation of the real time vacuuming signals from the stored vacuuming signals.

16. The method of claim 15, wherein the stopping of the pump comprises deenergizing and opening a normally open relay which closes for supplying operating energy to the pump.

17. The method of claim 15, wherein the storing of operating signals and the storing of vacuuming signals further comprise storing a profile of operating signals and a profile of vacuuming signals compared to time-from-pump-start, and wherein the comparing comprises comparing real time vacuum signals and time-from-start with the stored profiles.

18. The method of claim 17, further comprising providing the processor memory and comparator in a locked control enclosure, controlling calibration with a calibration switch from inside the locked enclosure, and controlling pump starting and vacuuming with switches on an outside of the locked enclosure.

19. A pool, spa or whirlpool bath circulating pump shut-off assembly comprising a pool, spa or whirlpool water-circulating pump, a suction line and a discharge line connected to the pump, a pump power source, a pump relay connected to the pump power source, pump power lines connected to the pump relay and to the pump for operating the pump, a pressure sensor connected to the suction line or the discharge line for sensing fluid pressures and for producing sensed pressure signals related to the sensed pressures, a processor having a memory connected to the sensor for storing the sensed pressure signals from the pressure sensor upon starting and operating the pump, and a comparator in the processor for comparing real time sensed pressure signals from the sensor with the stored sensed pressure signals, the pump relay connected to the processor for operating the relay for shutting off the pump in response to substantial differences in the real time sensed pressure signals and the stored sensed pressure signals.

20. The apparatus of claim 19, further comprising range spreading inputs connected to the processor for changing sensitivity range of the comparator to the real time sensed pressure signals beyond the stored sensed pressure signals within predetermined limits.

21. The apparatus of claim 19, further comprising a display connected to the processor for displaying condition of the processor.

22. The apparatus of claim 19, further comprising a start switch and a bypass switch separately connected to the processor for operating the processor in a circulating mode or in a pool vacuuming mode.

23. Pump control apparatus for a pool, spa or whirlpool bath comprising a pool, spa or whirlpool bath pump motor relay, a control connected to the pump motor relay, a processor connected to the control, a memory connected to the processor, a vacuum sensor having a sensing input connected to a suction side of a pool, spa or whirlpool bath pump and having a sensed vacuum signal output connected to the processor, a timer connected to the processor, a start switch for starting the pump, wherein the processor stores in the memory time inputs from the timer and sensed vacuum signal inputs from the vacuum sensor during normal operation of the pump, and a comparator connected to the processor for comparing real time sensed vacuum signal inputs to the processor from the vacuum sensor with inputs from the timer and the stored sensed vacuum signal inputs, an alarm relay connected to the processor, the processor connected to the pump relay and the alarm relay for operating the pump relay for turning off the pump, and operating the alarm relay for turning on the alarm.

24. The apparatus of claim 23, further comprising a pool vacuuming switch connected to the processor for operating the processor in a pool vacuuming mode.

25. Pools, spa or whirlpool bath water circulating pump control apparatus comprising:

a water holding pool, spa or whirlpool body;

a water inlet and a water outlet connected to the body;

a water return pipe connected to the water outlet;

a suction pipe connected to the water inlet;

a filter connected to the one of the pipes;

a pool, spa or whirlpool circulating pump having a suction side connected to the suction pipe and having a discharge side connected to the return pipe;

a pressure sensor connected to the suction side of the pump or to the suction pipe for sensing pressure therein and for producing pressure signals;

a pump relay having first and second power terminals and an energizing terminal;

electric power lines connected to the first power terminals of the pump relay;

pump power lines connected to the pump and connected to second power terminals of the pump relay;

a transformer having a low voltage output and having a high voltage input connected to the power lines;

an alarm relay having an energizing terminal and first and second power terminals;

the first power terminals of the alarm relay connected to the transformer;

an alarm connected to the second power terminals of the alarm relay;

a direct current power supply connected to the low voltage output of the transformer;

a microprocessor connected to the power supply, to the pressure sensor, to the pump relay and to the alarm relay;

a timer connected to the microprocessor;

a memory in the microprocessor for storing pressure signals from the sensor;

an on-off switch connected to the microprocessor for turning the microprocessor off or on;

a start switch connected to the microprocessor for starting the microprocessor in pump circulating condition for energizing the pump relay to operate the pump;

a vacuum cleaning switch connected to the microprocessor for setting the microprocessor in vacuum cleaning condition;

a comparator in the microprocessor for comparing present pressure signals from the sensor with the pressure signals stored in the memory for actuating the microprocessor upon substantial differences for energizing the alarm relay and deenergizing the pump relay for respectively turning on the alarm and turning off the pump.

26. A method of controlling a pool or spa circulating pump, comprising operating the pool or spa circulating pump, sensing vacuum on a suction side of the pump, signaling that sensed vacuum as sensed vacuum signals to a processor, storing the sensed vacuum Signals in a memory associated with the microprocessor, sensing operating vacuum on the suction side of the pump during later operating of the pump and providing real time vacuum signals from the sensed operating vacuum to the microprocessor, comparing the real time vacuum signals with the stored vacuum signals in the microprocessor, and stopping the circulating pump upon significant deviation of the real time vacuum signals from the stored vacuum signals.

27. The method of claim 26, further comprising vacuuming the pool or spa with the pump, sensing vacuum on the suction side of the pump during the vacuuming and producing sensed vacuuming signals, storing the sensed vacuuming signals as vacuuming calibration signals in the memory, providing real time vacuuming signals to the microprocessor during later pool or spa vacuuming operations, comparing the real time vacuuming signals to the stored vacuuming calibration signals and stopping the pump upon experiencing significant deviation of the real time vacuuming signals from the stored vacuuming signals.

28. The method of claim 27, wherein the storing of the sensed vacuum signals and the storing of the vacuuming signals further comprise storing a profile of sensed vacuum operating signals and a profile of vacuuming signals compared to time-from-pump-start, and wherein the comparing comprises comparing the real time vacuum signals and the real time vacuuming signals with the stored profiles.

* * * * *